US009636563B2

(12) United States Patent
Winter et al.

(10) Patent No.: US 9,636,563 B2
(45) Date of Patent: May 2, 2017

(54) TRAINING LIMB DEVICE

(71) Applicant: Rogers Athletic Company, Inc., Clare, MI (US)

(72) Inventors: Blaise Geoffrey Winter, Oviedo, FL (US); Zachary John Reger, Clare, MI (US); Kyle R. Camp, Clare, MI (US)

(73) Assignee: Rogers Athletic Company, Inc., Clare, MI (US)

( * ) Notice: Subject to any disclaimer, the term of this patent is extended or adjusted under 35 U.S.C. 154(b) by 33 days.

(21) Appl. No.: 14/608,614

(22) Filed: Jan. 29, 2015

(65) Prior Publication Data

US 2015/0209642 A1 Jul. 30, 2015

Related U.S. Application Data

(60) Provisional application No. 61/933,433, filed on Jan. 30, 2014.

(51) Int. Cl.
*A63B 69/00* (2006.01)
*A63B 69/34* (2006.01)

(52) U.S. Cl.
CPC ..... *A63B 69/34* (2013.01); *A63B 69/002* (2013.01); *A63B 69/004* (2013.01); *A63B 69/345* (2013.01); *A63B 2225/09* (2013.01)

(58) Field of Classification Search
CPC ..... A63B 69/004; A63B 19/00; A63B 69/345; A63B 2069/0044; A63B 69/20–69/325; F41B 15/02
See application file for complete search history.

(56) References Cited

U.S. PATENT DOCUMENTS

| | | | | |
|---|---|---|---|---|
| 5,542,667 | A * | 8/1996 | Lezdey | A63B 69/004 273/129 T |
| 7,214,169 | B1 * | 5/2007 | Clayton | A63B 21/0004 482/83 |
| 8,029,422 | B2 * | 10/2011 | Strong | A63B 69/004 482/83 |
| 2012/0238414 | A1 * | 9/2012 | Blaies | A63B 69/34 482/83 |
| 2014/0024503 | A1 * | 1/2014 | Chiang | A63B 69/004 482/83 |
| 2014/0336014 | A1 * | 11/2014 | Francis | A63B 69/203 482/88 |

* cited by examiner

*Primary Examiner* — Loan H Thanh
*Assistant Examiner* — Jennifer M Deichl
(74) *Attorney, Agent, or Firm* — Carlson, Gaskey & Olds, P.C.

(57) ABSTRACT

An exemplary training device includes a padded limb and a support to hold the padded limb at a position spaced from a trainer. An exemplary training method includes holding a padded limb at a position spaced from a trainer using a support grasped by the trainer, and repositioning the padded limb during a training exercise using the support.

16 Claims, 4 Drawing Sheets

TRAINING LIMB DEVICE

CROSS-REFERENCE TO RELATED APPLICATIONS

This application claims priority to U.S. Provisional Application No. 61/933,433, which was filed on 30 Jan. 2014 and is incorporated herein by reference.

TECHNICAL FIELD

This disclosure relates generally to sports equipment and, more particularly, to a device for training athletes in sports and activities, such as football and martial arts.

BACKGROUND

Athletes in many sports and activities can benefit from training. Various types of training devices have been developed to allow players to practice without facing off against another live player. This equipment often fails to provide accurate simulations of what the athlete will face on the field during the game, in an arena during a match, etc.

For example, training a defensive football player to utilize certain techniques for shedding the block of an offensive football player can improve the defensive player's performance during a game. A defensive pass rusher, for example, often needs to shed the block of an offensive lineman during a pass rush. The defensive pass rusher may strike and move the offensive lineman's hands, arms, or both to help the defensive linemen shed the block. Simulating the myriad of possible positions for the offensive player's limbs during training can be difficult.

SUMMARY

A training device according to an exemplary aspect of the present disclosure includes, among other things, a padded limb, and a support to hold the padded limb at a position spaced from a trainer.

In a further non-limiting embodiment of the foregoing training device, the support is external to the padded limb.

In a further non-limiting embodiment of any of the foregoing training devices, the support is removably securable to the padded limb.

In a further non-limiting embodiment of any of the foregoing training devices, the support is configured to manipulate the position of the padded limb in response to the trainer.

In a further non-limiting embodiment of any of the foregoing training devices, the training device includes a piston grip handle extending from transversely from the support.

In a further non-limiting embodiment of any of the foregoing training devices, the padded limb mimics a human arm and includes a hand portion, a forearm portion, and an upper arm portion.

In a further non-limiting embodiment of any of the foregoing training devices, the forearm portion is angled relative to the upper arm portion.

In a further non-limiting embodiment of any of the foregoing training devices, the padded limb is foam.

In a further non-limiting embodiment of any of the foregoing training devices, the padded limb is marked with at least one distinct strike zone.

In a further non-limiting embodiment of any of the foregoing training devices, a length of the support is adjustable A training method according to an exemplary aspect of the present disclosure includes, among other things, holding a padded limb at a position spaced from a trainer using a support grasped by the trainer, and repositioning the padded limb during a training exercise using the support.

In a further non-limiting embodiment of the foregoing training method, the padded limb and the support are directly connected to each other.

In a further non-limiting embodiment of any of the foregoing training methods, the method includes placing a portion of the support between an arm of the trainer and a body of the trainer when manipulating the position of the padded limb.

In a further non-limiting embodiment of any of the foregoing training methods, the method includes grasping a pistol grip with a hand of the trainer when manipulating the position of the padded limb, the piston grip extending transversely from the support.

In a further non-limiting embodiment of any of the foregoing training methods, the padded limb mimics a human arm.

In a further non-limiting embodiment of any of the foregoing training methods, the padded limb is first padded limb and the support is a first support, and the method further comprises holding a second padded limb at a position spaced from the trainer using second support grasped by the training.

In a further non-limiting embodiment of any of the foregoing training methods, the method further comprises adjusting a length of the support to adjust a distance between the trainer and the padded limb during the holding.

In a further non-limiting embodiment of any of the foregoing training methods, the trainer interfaces exclusively with the support during the holding and the repositioning.

In a further non-limiting embodiment of any of the foregoing training methods, the trainer is spaced from all portions of the padded limb during the holding and the repositioning.

In a further non-limiting embodiment of any of the foregoing training methods, the method further comprises striking the padded limb during a training exercise during the holding.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
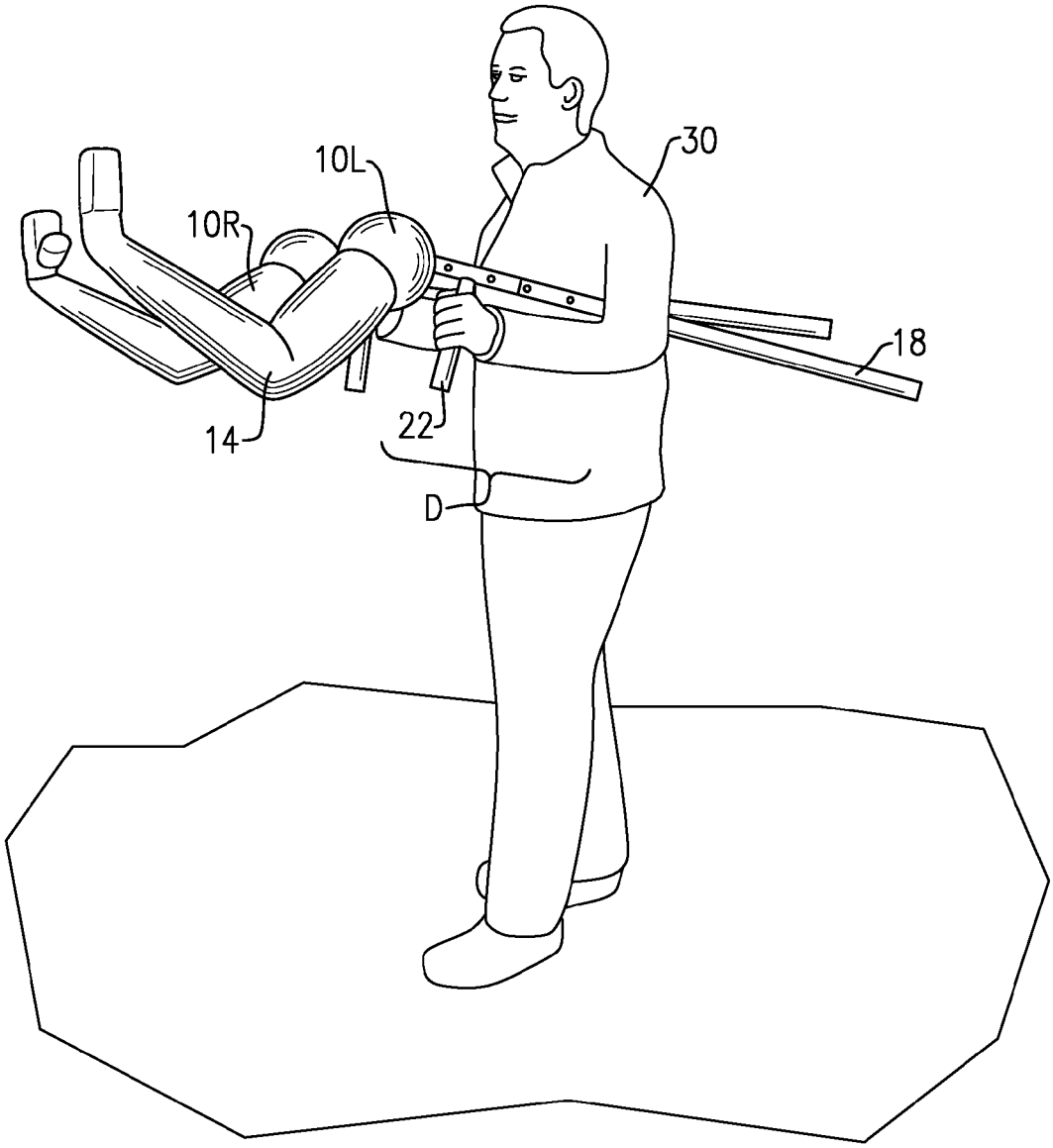
FIG. 1 shows a perspective view of example training devices held by a coach.
Figure 2D:
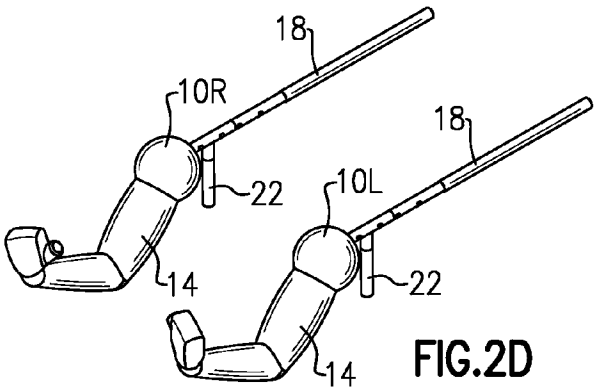
FIG. 2D shows a perspective view of the training devices of FIG. 2A.
Figure 2E:
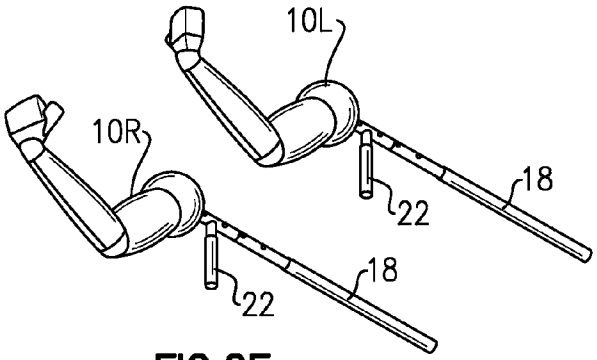
FIG. 2E shows another perspective view of the training devices of FIG. 2A.
Figure 2F:
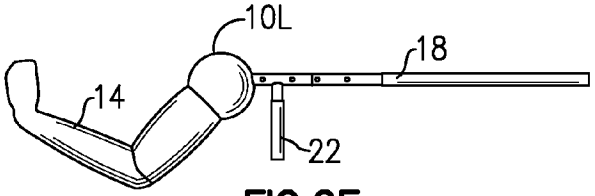
FIG. 2F shows a side view of the training devices of FIG. 2A.
Figure 2A:
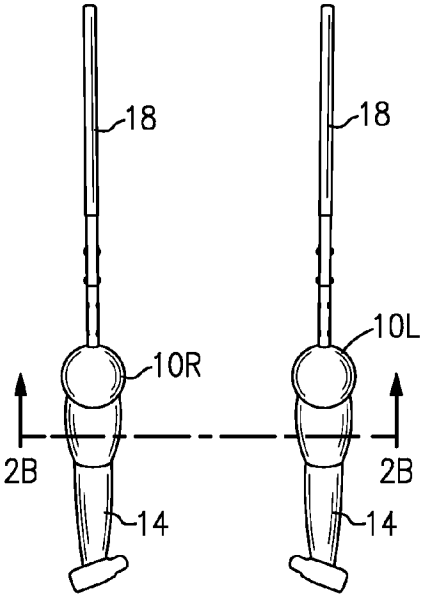
FIG. 2A shows a top view of the training devices of FIG. 1 without the coach.
Figure 2B:
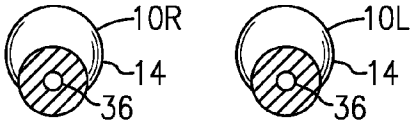
FIG. 2B shows a section view of the training devices at line 2B-2B in FIG. 2A.
Figure 2C:
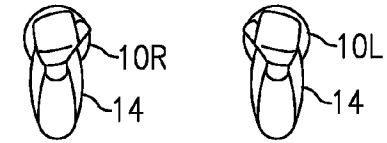
FIG. 2C shows a front view of the training devices of FIG. 2A.
Figure 3:
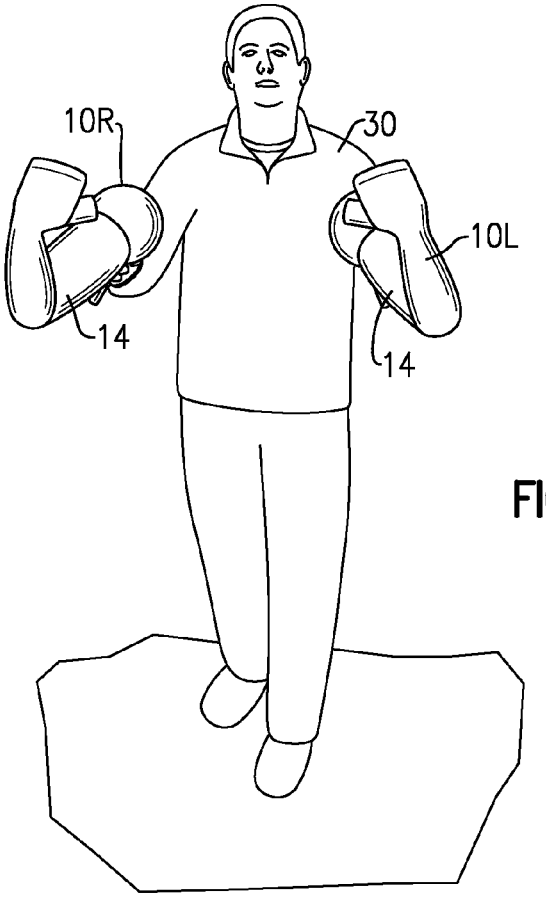
FIG. 3 show a front view of the training devices of FIG. 1.
Figure 4:
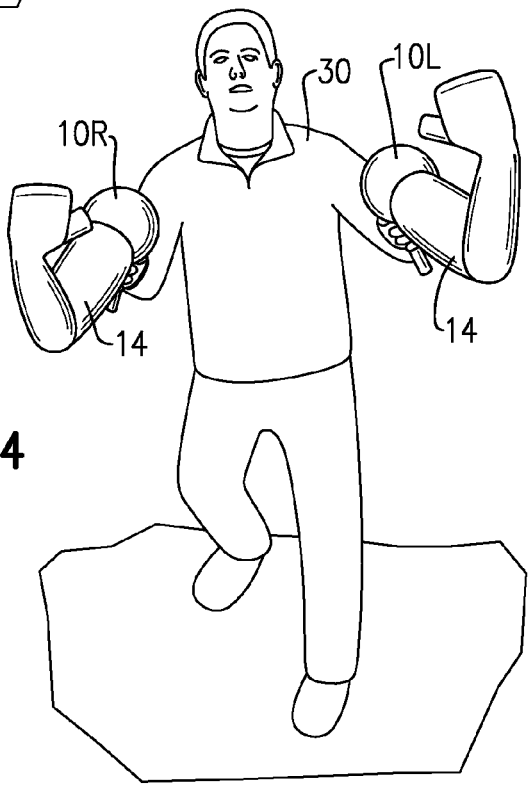
FIG. 4 shows a front view of the training devices of FIG. 1 and a training mode.

Referring to FIGS. 1 to 4, example training limb assemblies 10R and 10L each include a padded limb 14, a support 18, and a pistol grip handle 22. The training limb assembly 10R represents a right arm and the training limb assembly 10L represents a left arm. Using the supports 18 and the handles 22, a coach 30 (or trainer) can reposition the padded limbs 14 of the assemblies 10R and 10L to train an athlete (not shown) in various athletic techniques.

For each of the assemblies 10R and 10L, one end of the supports 18 connects to the padded limb 14. Another end of the supports 18 fits between an arm and torso of the coach 30. A shoulder harness can attach to the supports 18 to assist the coach 30 in holding the assemblies 10R and 10L. The supports 18 provide stability to the padded limbs 14.

The supports 18 are steel in some examples. In other examples, the supports 18 are made from another material.

The example supports 18 have a circular cross-section, but could be square in other examples.

The handles 22 extend downwardly from the supports 18 near a center of gravity for the assemblies 10R and 10L. The coach's hands grasp the handles 22.

Placing the padded limb 14 at the end of the supports 18 enables the padded limbs 14 to be spaced a distance D from the torso of the coach 30 during a training exercise. The athlete's interactions with the padded limbs 14 are thus also the spaced from the coach 30. This provides the athlete with freedom to move, maneuver, and train. The length of the supports 18 is adjustable, in some examples, to allow the coach to vary the distance D.

In some prior art designs, pads were attached directly to a coach's arms and used during training. This approach disadvantageously placed the coach very near to the athlete during training and left little area for athlete movement.

The example supports 18 can engage rods 36, such as aluminum or steel rods extending along an interior of the padded limbs 14. The rods 36 may extend outside the padded limbs 14 in some examples.

The supports 18 can be removably engaged with the padded limbs 14 through the rods 36. The rods 36 may have a circular cross-section, as shown, or another type of cross-sectional profile.

When the supports 18 are removed from the padded limbs 14, the padded limbs 14 may then be installed on another type of training apparatus, such as a torso pad.

The example padded limbs 14 are made of self-skinning foam surrounding the rods 36. The padded limbs 14 are shaped like arms in this example. In other examples, the padded limbs can be shaped like legs.

Figure 5:
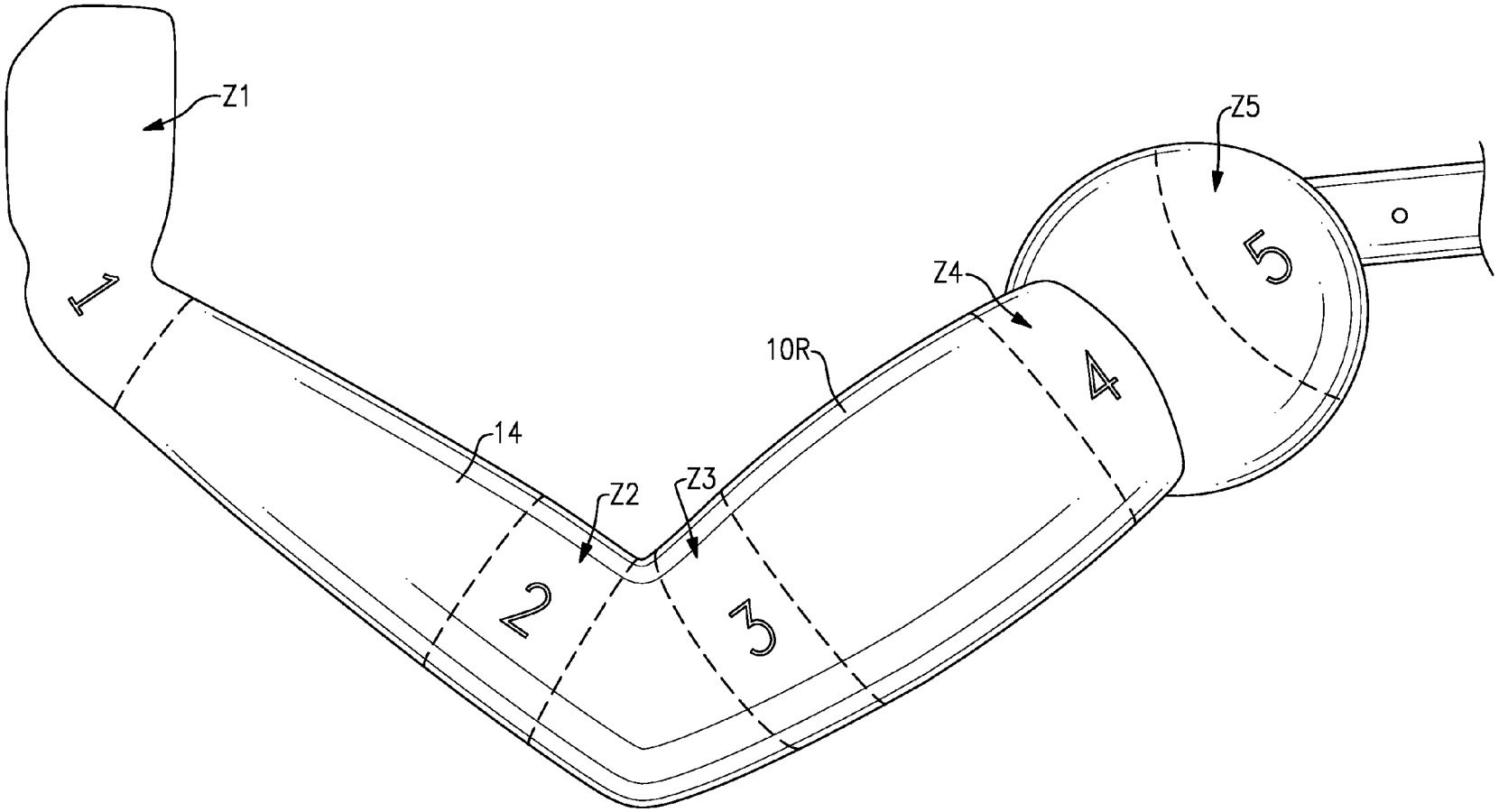
FIG. 5 shows a close up view of target zones on one of the training devices of FIG. 1.

Referring to FIG. 5, the example padded limbs 14 include five separate target zones. The zones include at least zone one Z1, zone two Z2, zone three Z3, zone four Z4, and zone five Z5. During a training exercise, the athlete may train by engaging or striking one of the zones, such as by striking the strike zone two.

The coach 30 may instruct the athlete during a training exercise by a sequenced vocal command such as "two, four," which would prompt the athlete to strike near an elbow and then an upper arm area of the padded limb 14.

The assemblies 10L, 10R, or both, may be utilized during various types of training, including football training and marital arts training.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A training device comprising:

a padded limb that is foam, wherein the padded limb is formed as a human arm and includes a hand portion, a forearm portion, and an upper arm portion;

a support to hold the padded limb at a position spaced from a trainer, wherein a portion of the support is configured to fit between an upper arm and a torso of the trainer, wherein a length of the support is adjustable; and a handle extending transversely from the support configured to be grasped by a hand of the trainer.

2. The training device of claim 1, wherein the support is external to the padded limb.

3. The training device of claim 1, wherein the support is removably securable to the padded limb.

4. The training device of claim 1, wherein the support is configured to manipulate the position of the padded limb in response to the trainer.

5. The training device of claim 1, wherein the handle is a pistol grip handle.

6. The training device of claim 1, wherein the forearm portion is angled relative to the upper arm portion.

7. The training device of claim 1, wherein the padded limb is marked with at least one distinct strike zone.

8. A training method, comprising:

holding a padded limb at a position spaced from a trainer using a support grasped by the trainer;

repositioning the padded limb during a training exercise using the support;

placing a portion of the support between an upper arm of the trainer and a body of the trainer during the holding; and grasping a handle extending transversely from the support with a hand of the trainer during the holding.

9. The training method of claim 8, wherein the padded limb and the support are directly connected to each other.

10. The training method of claim 8, wherein the handle comprises a pistol grip.

11. The training method of claim 10, wherein the padded limb mimics a human arm.

12. The training method of claim 8, wherein the padded limb is first padded limb and the support is a first support, and the method further comprises holding a second padded limb at a position spaced from the trainer using second support grasped by the training.

13. The training method of claim 8, further comprising adjusting a length of the support to adjust a distance between the trainer and the padded limb during the holding.

14. The training method of claim 8, wherein the trainer interfaces exclusively with the support during the holding and the repositioning.

15. The training method of claim 8, wherein the trainer is spaced from all portions of the padded limb during the holding and the repositioning.

16. The training method of claim 8, further comprising striking the padded limb during a training exercise during the holding.

* * * * *